United States Patent [19]

Worden

[11] 4,452,839

[45] Jun. 5, 1984

[54] FORM AND METHOD OF FABRICATING A GLASS LAMPSHADE

[76] Inventor: Howard L. Worden, P.O. Box 519, Granger, Wash. 98932

[21] Appl. No.: 382,489

[22] Filed: May 27, 1982

[51] Int. Cl.[3] ..... B44F 1/06; B44F 3/00

[52] U.S. Cl. ..... 428/38; 29/464; 156/63; 362/351; 428/432; 428/542.8

[58] Field of Search ..... 428/38, 49, 432, 542.8; 29/464; 40/554; 156/63; 362/351, 356

[56] References Cited

U.S. PATENT DOCUMENTS 3,872,574 3/1975 Worden ..... 29/464 X
3,963,233 6/1976 Worden ..... 428/38 X
4,009,309 2/1977 Holt ..... 428/38
4,110,393 8/1978 Trame ..... 428/38 X

*Primary Examiner*—Henry F. Epstein
*Attorney, Agent, or Firm*—Seed and Berry

[57] ABSTRACT

A sectional form for fabricating Tiffany-type lampshades and a method for fabricating such lampshades include a form having an alignment grid affixed to the outer surface thereof. Cartoon strips corresponding in shape to the regions of the alignment grid are releasably secured to the outer surface of the form and cut glass is thereafter assembled into sections of a glass lampshade on the form. Single or multiple sets of cartoon strips may be used to assemble a lampshade having either a repeating or nonrepeating design.

6 Claims, 4 Drawing Figures

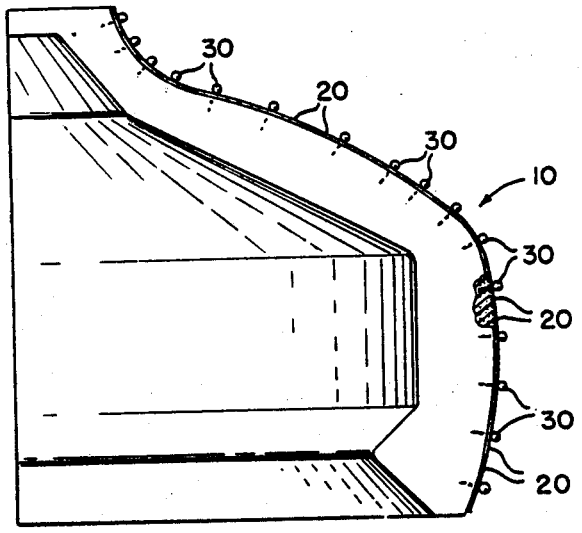
FIG. 3
FIG. 4
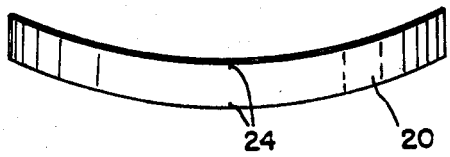

FORM AND METHOD OF FABRICATING A GLASS LAMPSHADE

DESCRIPTION

TECHNICAL FIELD

This invention relates to forms for fabricating Tiffany-type lampshades and improved methods for fabricating such lampshades.

BACKGROUND ART

Tiffany-type lampshades generally comprise a plurality of small pieces of stained glass secured to one another by copper foil or lead came to form a desired shape and design. The expense of purchasing finished lampshades of this type has led to the popularity of kits and molds which facilitate home fabrication of Tiffany-type lampshades. In the past, these kits have included expensive and bulky molds upon which the fabricator assembled an entire shade. When using these molds, it is necessary for the fabricator to rotate relative to the mold, or vice versa, to assemble an entire lampshade.

More recently, lightweight sectional forms have been developed which allow a fabricator to assemble a lampshade in sections which are then connected together when all sections are complete. Lightweight sectional forms of this type are disclosed in U.S. Pat. Nos. 3,872,574 and 3,963,233, to H. L. Worden. The disclosures of these patents are hereby incorporated by reference. Sectional forms of this type are constructed by taking a solid mold with an outer surface of a desired shape and cutting a pie-shaped section out of it. The mold is shaped so that the sectional forms will stand upright on a table. A pattern, or "cartoon," as they are known in the trade, is permanently affixed on the outer surface of the sectional form. The cartoon is comprised of color-coded regions to indicate the color of glass which the fabricator is to place on each portion of the sectional form. Each section of the lampshade is assembled by placing individual pieces of cut glass corresponding in size and color to the regions of the cartoon and connecting each piece to the surrounding pieces using copper foil or lead came.

Although these sectional forms have many advantages over the bulky molds which preceded them, they still have several drawbacks. Once a fabricator has purchased a given sectional form, for example, he may make only one lampshade design from that form. Additionally, retailers of such sectional forms must maintain a large inventory in order to stock a wide variety of designs. As both the shape of the form and the design on the form may vary, it is difficult for a retailer to offer the selection desired by the fabricator/hobbyist. This is especially true because retail outlets for the sectional forms are often small hobby shops.

Another drawback of existing sectional forms is that they are not well adapted to permit a fabricator/hobbyist to fabricate a lampshade of his or her own design.

Yet another drawback of existing sectional forms is that the design of the completed lampshade is necessarily a repetition of a smaller design. If the sectional form is one-fifth of an entire mold, for example, the design of the completed shade will be a repetitious pattern of five smaller designs.

DISCLOSURE OF THE INVENTION

It is an object of this invention to provide a sectional form for fabricating Tiffany-type lampshades which can be used to fabricate a plurality of designs.

It is another object of this invention to provide such a form which can be reused by the fabricator for different designs.

It is another object of this invention to provide such a form which will permit a glass lampshade having a nonrepetitious design to be fabricated.

It is another object of this invention to provide such a form which will facilitate use of original designs when fabricating a Tiffany-type lampshade.

It is another object of this invention to provide a method of fabricating a Tiffany-type lampshade from sectional forms which will permit a plurality of lampshades of varying designs to be fabricated from a single form.

It is another object of this invention to provide a method of fabricating a Tiffany-type lampshade from a sectional form which will facilitate the use of original designs.

It is another object of this invention to provide a method of fabricating such a lampshade from sectional forms which will allow use of a single nonrepetitious design for the entire lampshade.

It is another object of this invention to provide a method of fabricating a Tiffany-type lampshade from sectional forms which will permit reuse of such forms by the fabricator.

These and other objects which will become apparent as the invention is more fully described below are obtained by providing a sectional form of conventional shape. The outer surface of the sectional form includes an alignment grid affixed thereto. A plurality of thin, elongated cartoon strips sized to correspond to the dimensions of the alignment grid are releasably secured to the outer portion of the sectional form using pins or the like. The outer surfaces of these cartoon strips combine to form a complete cartoon covering the outer surface of the sectional form. The fabricator may easily assemble a section of the glass lampshade over the sectional form and cartoon strips, as would be done with a conventional sectional form. Once a lampshade is completely assembled, the cartoon strips may be removed from the sectional form, leaving the alignment grid exposed. To fabricate a second design using the same sectional form, the fabricator need only acquire an additional set of cartoon strips.

BRIEF DESCRIPTION OF THE DRAWINGS

FIG. 3 is a cross-sectional view of the sectional form of FIG. 2 taken through line 3—3 of FIG. 2.

FIG. 4 is an isometric view of a single cartoon strip.

BEST MODE FOR CARRYING OUT THE INVENTION

Figure 1:
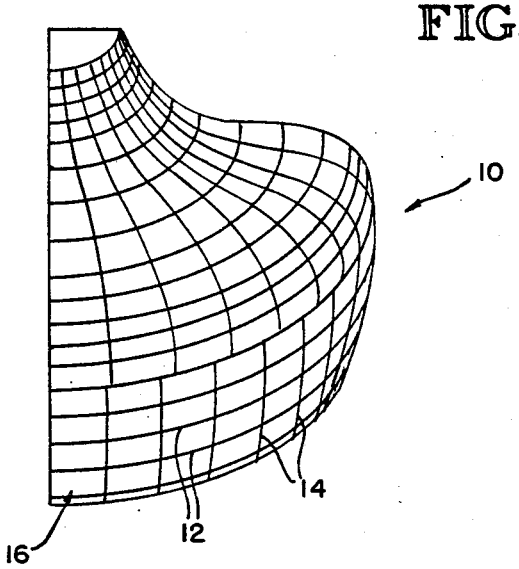
FIG. 1 is an isometric view of a sectional form showing the alignment grid on the outer surface of the form.

An improved sectional form designed to be used in the improved method of fabrication described herein is shown in FIG. 1. The exterior shape of the sectional form 10 is selected in accordance with the shape of the lampshade desired to be fabricated. A series of horizontal grid lines 12 and vertical grid lines 14 are affixed to the outer surface of the sectional form 10 to create an alignment grid 16 thereon.

Figure 2:
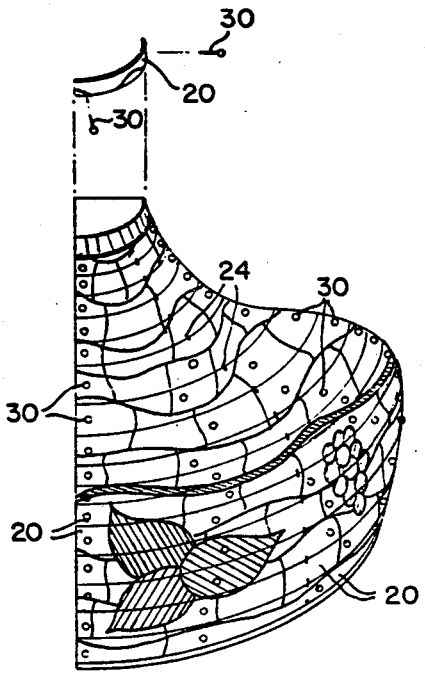
FIG. 2 is an isometric view of a sectional form having a plurality of cartoon strips affixed thereto.

In order to make the sectional form 10 usable as a mold on which sections of a lampshade may be assembled, cartoon strips 20, such as the one illustrated in FIG. 4, must be place over the alignment grid 16 of the sectional form 10. The outer side of each cartoon strip 20 contains color-coded marking so that when all strips 20 are secured to the sectional form 10, as seen in FIG. 2, a complete design will be formed. The cartoon strips 20 are sized such that the width of each strip corresponds to the spacing of the horizontal grid lines 12 between which it is to be placed. As seen in FIG. 1, the spacing of the horizontal grid lines 12 preferably decreases in the regions of steep curvature of the outer surface of the sectional form 10 to ensure that the flat cartoon strips 20 can conform to the outer surface of the sectional form 10 without excessive bending. The cartoon strips preferably include vertical alignment indicia 24 which aid the fabricator in aligning the cartoon strips 20 with the vertical grid lines 14 and indicia 24 of the other cartoon strips. Proper alignment will ensure that the cartoon strips 20, once placed over the alignment grid 16, will form a coherent pattern over which a lampshade may be fabricated.

In the embodiment illustrated in FIGS. 1–4, the sectional form is fabricated of polystyrene or similar material. The cartoon strips 20 are of paper construction and are held releasably secured to the outer surface of the sectional form 10 using pins 30.

To assemble a lampshade using the sectional form 10, as illustrated herein, the fabricator preferably first places the form 10 on a flat supporting surface. The cartoon strips are then selectively placed between the proper horizontal grid lines 12 and secured to the sectional form 10 using pins 30 or other securing means. Once all of the cartoon strips 20 are in place on the sectional form 10, the fabricator places pieces of cut glass over the cartoon strips, as indicated by the pattern on the cartoon strips 20. The glass pieces are secured to one another using copper foil, lead came, or other known means. When an entire segment is complete, it is removed and set aside. The fabricator then completes the additional number of sections necessary to form a complete lampshade. Once all of the sections are complete, the individual segments of the lampshade are secured to one another to form a complete shade.

If it is desired to avoid the use of a repeating pattern for the lampshade design, a plurality of sets of cartoon strips may be used. For example, if a one-quarter sectional form is used, four sets of cartoon strips would be provided. After each set of cartoon strips is secured to the sectional form 10, the fabricator would form one section of the lampshade as described above. Rather than forming the second lampshade section in an identical manner, the fabricator would replace the first set of cartoon strips with the second set and proceed to fabricate a second lampshade section having a different design than the first. Proceeding in this manner, a complete shade having one non-repeating pattern can be fabricated.

After the lampshade has been assembled, the fabricator may remove the cartoon strips and replace them with a different set or sets of cartoon strips containing a different pattern thereon. With a new cartoon strip in place, the fabricator may repeat the process described above to produce a lampshade of the same shape, having a new design thereon. It thus becomes unnecessary for the fabricator to purchase duplicate forms for every design he or she wishes to assemble. Similarly, retailers of such forms need only stock sectional forms of varying shape. By stocking five or six basic exterior shapes, such retailers may offer their customers a wide variety of differing designs by merely stocking a plurality of different cartoon strips for each shape. This is of great advantage to the retailers as a set of cartoon strips takes up much less storage space than an entire sectional form.

Although the improved sectional form and improved method of fabricating a glass lampshade have been described herein for use with sectional forms only, it will be obvious to one of ordinary skill in the art that the improvements described herein would be equally usable on molds representing the shape of an entire lampshade. When a grid and cartoon strip method is used with these types of molds, however, the full advantages of the sectional form molds are, of course, not obtained. Additionally, although the improved sectional forms and improved method of fabricating a glass lampshade have been described herein in reference to FIGS. 1–4, it will be obvious to those of ordinary skill in the art that many modifications of what is described here could be achieved without departing from the spirit of this invention. It is not the intent of the applicant herein to limit his invention to the specific embodiments disclosed herein.

I claim:

1. A method of fabricating a lampshade or the like which comprises:

fabricating a plurality of segments of the shade by the steps of:

(a) placing a form which represents a segment of the completed lampshade upon a supporting surface, the form having a grid of horizontal and vertical lines on its outer surface;

(b) aligning a plurality of cartoon strips with the grid on the outer surface of the form and securing the strips to the form;

(c) placing a series of discrete pieces of glass on the strips;

(d) securing the discrete pieces to one another to form a rigid segment of the shade;

(e) removing the segment of the shade from the form and attached strips; and securing a plurality of segments of the shade to one another to form a complete shade.

2. A method of constructing a sectional form for fabricating a lampshade comprising the steps of:

(a) producing an original mold which reflects the desired shape of the shade;

(b) producing from the original mold at least one sectional form defining a partial mold which is an integer portion of the original, whereby an integer number of sectional forms identical to the sectional form may be joined together to reproduce the shape of the original mold; and (c) applying a grid to the outer surface of the sectional form for aligning a plurality of cartoon strips to the outer surface of the sectional form.

3. A sectional form for fabricating a glass lampshade which comprises:

an outer surface corresponding in shape to the desired shape of the lampshade, the dimensions of the outer surface corresponding to an integer section of the complete lampshade;

a plurality of cartoon strips having a pattern on one side thereof;

an alignment grid affixed to the outer surface of the sectional form for aligning the cartoon strips on the outer surface of the sectional form; and means for releasably securing the cartoon strips to the outer surface of the sectional form.

4. The sectional form of claim 3, further including vertical indicia lines on the cartoon strips for aligning the cartoon strips to the alignment grid and indicia on adjacent cartoon strips.

5. The sectional form of claim 3 wherein the cartoon strips extend lengthwise across the width of the form, the length of the cartoon strips corresponding to the width of the form at the location where the cartoon strip is releasably secured to the form.

6. The sectional form of claim 3 wherein the alignment grid is comprised of a plurality of spaced-apart vertical and horizontal lines, the spacing between the lines decreasing as the curvature of the form increases.

* * * * *